US006241923B1

(12) United States Patent
Sakai

(10) Patent No.: US 6,241,923 B1
(45) Date of Patent: Jun. 5, 2001

(54) PROCESS FOR THE PRODUCTION OF CARBON FIBERS

(75) Inventor: Yukio Sakai, Tsukuba (JP)

(73) Assignee: Mitsubishi Gas Chemical Company, Inc., Tokyo (JP)

( * ) Notice: Subject to any disclaimer, the term of this patent is extended or adjusted under 35 U.S.C. 154(b) by 0 days.

(21) Appl. No.: 09/335,740

(22) Filed: Jun. 18, 1999

(30) Foreign Application Priority Data

Jun. 29, 1998 (JP) ..... 10-182288
Jul. 14, 1998 (JP) ..... 10-199158

(51) Int. Cl.[7] ..... D01F 9/145
(52) U.S. Cl. ..... 264/29.2; 264/29.6; 264/29.7; 423/447.6; 423/447.7; 423/447.8
(58) Field of Search ..... 264/29.2, 29.6, 264/29.7; 423/447.6, 447.7, 447.8

(56) References Cited

U.S. PATENT DOCUMENTS 5,356,574 * 10/1994 Tamaki et al. ..... 264/29.2

* cited by examiner

*Primary Examiner*—Leo B. Tentoni
(74) *Attorney, Agent, or Firm*—Wenderoth, Lind & Ponack, L.L.P.

(57) ABSTRACT

A process for the production of carbon fibers, including melt-spinning mesophase pitch having an optically anisotropic content of at least 90%, a softening point of 190° C. to 280° C. and a heating weight loss of 0.7% by weight or less at a spinning temperature to form a spun fiber, infusibilizing the spun fiber to obtain an infusible fiber and carbonizing the infusible fiber.

8 Claims, No Drawings

PROCESS FOR THE PRODUCTION OF CARBON FIBERS

FIELD OF THE INVENTION

The present invention relates to a process of producing high-performance pitch-based carbon fibers continuously and stably for a long time and a process for the production of high-performance pitch-based carbon fibers having high strength and high elastic modulus.

PRIOR ART OF THE INVENTION

Generally, high-performance carbon fibers are industrially produced from PAN (polyacrylonitrile) as a raw material, while PAN is expensive and its carbonization yield is low. In recent years, it has been found that high-performance carbon fibers can be produced from pitch as a raw material.

Pitch for carbon materials includes optically isotropic pitch and optically anisotropic pitch. Carbon fibers produced from isotropic pitch are inexpensive, while such carbon fibers are poor in strength due to its poor molecular orientation. Therefore, high-performance carbon fibers can not be obtained from the isotropic pitch. In contrast, carbon fibers produced from anisotropic pitch called "mesophase pitch" have a higher degree of molecular orientation so that such carbon fibers show excellent mechanical properties in strength and elastic modulus.

Thus, there have been developed methods of producing mesophase pitch as a raw material for high-performance carbon fibers from pitch obtained from catalystic cracked oil of petroleum, petroleum tar pitch or coal tar pitch.

When fibers are produced from this mesophase pitch by a melt-spinning method, the developed aromatic planar molecules are brought into alignment with the fiber-axis because of the shear stress exerted when the pitch passes through nozzle holes. This structure is maintained in subsequent infusibilization and carbonization without being disturbed, so that highly oriented, high-performance carbon fibers can be obtained.

The pitch-based carbon fibers have characteristic features that yield in a carbonization step is large and that the elastic modulus is high, while the pitch-based carbon fibers are extremely inferior in spinning properties to PAN-based carbon fibers. The reason is as follows. Since the mesophase pitch is composed of complicated compounds, a spinning nozzle is soiled due to the alteration by heat and smoking at spinning. As a result, it is difficult to perform spinning for a long time. Further, the above fact also makes it difficult to impart sufficient strength to the carbon fibers.

As for the production of pitch-based carbon fibers, therefore, there are some attempts of producing carbon fibers more stably. However, no carbon fibers equivalent to PAN-based carbon fibers have yet obtained.

The present inventors have proposed a process for the production of mesophase pitch which is excellent in infusibilization properties and has a low softening point and high mesophase content, bypolymerizing a condensedpolycyclic aromatic hydrocarbon such as naphthalene by the use of HF-BF3 (Japanese Patent Number 2,562,585, Japanese Patent Number 2,621,253). However, although this pitch has a low softening point, this pitch still has large contents to be vaporized. As a result, improvements are required for carrying out a continuous spinning for a long time.

SUMMARY OF THE INVENTION

It is an object of the present invention to provide a process for the production of pitch-based carbon fibers, which process can produce high-performance carbon fibers continuously and stably for a long time.

It is another object of the present invention to provide a process for the production of pitch-based carbon fibers, which process can stably produce high-performance carbon fibers having high strength and high elastic modulus.

According to the present invention, there is provided a process for the production of carbon fibers, comprising melt-spinning mesophase pitch having an optically anisotropic content of at least 90%, a softening point of 190° C. to 280° C. and a heating weight loss of 0.7% by weight or less at a spinning temperature to form a spun fiber, infusibilizing the spun fiber to obtain an infusible fiber and carbonizing the infusible fiber.

According to the present invention, further, there is provided a process for the production of carbon fibers, comprising melt-spinning mesophase pitch having an optically anisotropic content of at least 90%, a softening point of 190° C. to 280° C. and a difference of 30° C. or less between a flow starting temperature and the softening point, measured with a flow tester, to form a spun fiber, infusibilizing the spun fiber to obtain an infusible fiber and carbonizing the infusible fiber.

DETAILED DESCRIPTION OF THE INVENTION

The present inventors have made diligent studies on a process for the production of pitch-based carbon fibers, which process can continuously and stably produce high-performance carbon fibers for a long time and, as a result, found the following. Continuous spinning excellent in spinning properties can be stably carried out for a long time by spinning mesophase pitch having a high optically anisotropic content, a softening point in the specific range and a low heating weight loss at a spinning temperature to form a spun fiber, infusibilizing the spun fiber to obtain an infusible fiber and carbonizing the infusible fiber. Thereby, pitch-based carbon fibers excellent in fiber properties can be obtained.

That is, for the stabilization of spinning, the mesophase pitch must be composed of thermally stable molecules and light contents must be removed completely. It has been found that these features are particularly closely related to the heating weight loss at a spinning temperature. As a result, the present invention has been accomplished.

That is, the present invention 1 is directed to a process for the production of carbon fibers, comprising melt-spinning mesophase pitch having an optically anisotropic content of at least 90%, a softening point of 190° C. to 280° C. and a heating weight loss of 0.7% by weight or less at a spinning temperature to forma spun fiber, then infusibilizing the spun fiber to obtain an infusible fiber and carbonizing the infusible fiber.

Further, the present inventors have made more studies and as a result found that, for obtaining carbon fibers having high strength and high elastic modulus, the softening point and the distribution of component molecules are also important other than the optically anisotropic content of mesophase pitch. That is, the present inventors have found that mesophase pitch having an optically anisotropic content, a softening point and a difference between a flow starting point and the softening point, which difference is the index of the distribution of the component molecules, in their specific ranges, has a high orientation, a narrow distribution of component molecules and an excellent flowability. Further, it has been found that high-performance carbon fibers can be stably produced by spinning, infusibilizing and carbonating pitch having such properties. As a result, the present invention has been accomplished.

That is, the present invention 2 provides a process for the production of carbon fibers, comprising melt-spinning mesophase pitch having an optically anisotropic content of at least 90%, a softening point of 190° C. to 280° C. and a difference of 30° C. or less between a flow starting temperature and the softening point, measured with a flow tester, to form a spun fiber, infusibilizing the spun fiber to obtain an infusible fiber and carbonizing the infusible fiber.

Mesophase pitch of a high optically anisotropic content is used as a raw material for the carbon fibers to be produced by the process of the present invention 1 or the present invention 2. A condensed polycyclic aromatic hydrocarbon such as naphthalene, methyl naphthalene or anthracene, various petroleum fractions having these skeletons, the residual oil originating from petroleum processing steps and petroleum tar fractions are used as a raw material for the mesophase pitch.

The mesophase pitch may be produced by a conventional thermal polymerization, while the production process in which polymerization is carried out by using hydrogen fluoride and boron trifluoride as a catalyst is especially suitable.

When the polymerization is carried out in the presence of hydrogen fluoride and boron trifluoride as a catalyst, the amount of the hydrogen fluoride is 0.2 to 1 mole and the amount of the boron trifluoride is 0.05 to 0.5 mole per mole of the condensed polycyclic aromatic hydrocarbon as a raw material. When the amount of the hydrogen fluoride exceeds 1 mole or when the amount of the boron trifluoride exceeds 0.5 mole, disadvantageously, the amount of circulation of the catalyst increases and a larger reactor is required. When the amount of the hydrogen fluoride is smaller than 0.2 mole or when the amount of the boron trifluoride is smaller than 0.05 mole, it is impossible to obtain mesophase pitch having an optically anisotropic content of at least 90%.

The time required for the polymerization is usually 30 to 300 minutes though it changes depending upon the kind of a raw material, the reaction temperature and the amount of catalyst.

The catalyst is separated after the completion of polymerization, and light contents are removed in the presence of an inert gas in the temperature range of 300 to 500° C., preferably 340 to 450° C., for from 1 minute to 60 hours, to obtain mesophase pitch.

In the present invention 1, the mesophase pitch used as a raw material for the carbon fibers has an optically anisotropic content of at least 90%, preferably 100%, a softening point of 190 to 280° C., preferably 200 to 260° C., and a heating weight loss of 0.7% by weight or less at a spinning temperature. It is required to set the reaction conditions, the conditions to remove light contents, and the like, so as to obtain such mesophase pitch.

In the present invention 2, the mesophase pitch used as a raw material for the carbon fibers has an optically anisotropic content of at least 90%, preferably 100%, a softening point of 190° C. to 280° C., preferably 200° C. to 260° C. and a difference of 30° C. or less between a flow starting temperature and the softening point, measured with a flow tester. It is required to set the reaction conditions, the conditions to remove light contents, and the like, so as to obtain such mesophase pitch.

The melt-spinning of mesophase pitch, the infusibilization and the carbonization are carried out by a general method, while one example is shown as follows.

The nozzle of about 0.25 mm is used for the melt-spinning, and the melt-spinning is carried out at 265 to 355° C. at a rate of about 500 m/min under a nitrogenous pressure of 1 to 3 kg /cm$^2$G. The infubilization is carried out by increasing temperature from ambient temperature to 250–300° C. at a rate of 1 to 5° C./min under a usual air circulation. The carbonization is carried out by increasing temperature under an inert atmosphere current at a rate of about 10° C./min.

In the present invention, the term "mesophase" means the content of a phase which shows an optical anisotropism when observed with a polarizing microscope. The term "mesohase content" refers to the proportion taken by the area of this optically anisotropic phase under observation with a polarizing microscope.

When this mesophase content is small, the anisotroic phase and isotropic phase separate in a molten state to prevent the spinning operation. Therefore, the mesophase content is required to be at least 90%, 100% if possible. When, however, the mesophase content is high, generally, the softening point and viscosity of pitch are increased and it is therefore difficult to perform spinning stably. That is, since the softening point and viscosity are high, the spinning is required to be carried out at a high temperature. The thermal decomposition or thermal condensation of pitch is therefore liable to happen, and gases and infusible high molecular substances are generated. It is difficult to continue stable spinning for a long time.

In the present invention, the softening point of mesophase pitch is measured with a flow tester (supplied by Shimazu Seisakusho) under the load of 10 kg at a rate of temperature increase of 6° C. per minute.

When this softening point is higher than 280° C., spinning at high temperatures becomes necessary as mentioned above, and it becomes difficult that stable spinning is continued for a long time. When the softening point is lower than 190° C., it is impossible to obtain mesophase having a high optically anisotropic phase, and it becomes difficult to obtain high-performance carbon fibers.

The heating weight loss at a spinning temperature is measured by increasing a temperature at a rate of 10° C. per minute from an ambient temperature to a spinning temperature under a nitrogenous atmosphere and maintaining the temperature for 2 hours. When the heating weight loss at a spinning temperature is larger than 0.7 weight % by weight, it is difficult to stably carry out spinning for a long time since the pitch is changed in properties by heating and generates smoking at the time of spinning.

So far, though there is a proposal in which pitch is prescribed by such a heating weight loss (JP-A 3-14625), the heating weight loss at high temperatures is prescribed, which temperatures are far from the spinning temperature, and there are no relations as for the smoking in actual at the time of spinning. There are various mesophase pitches. Some mesophase pitches generates gases at a spinning temperature. Some mesophase pitches scarcely generates gases at a spinning temperature but generates gases at higher temperatures. However, the problem is a gas generation at the time of spinning and the thermal stability at a spinning temperature is important therefor.

When mesophase pitch in which the difference between a flow starting temperature and a softening point, measured with a flow tester, is larger than 30° C. is used, high-performance carbon fibers can not be obtained since the molecular weight distribution is wide and the flowability is poor.

The mesophase pitch is composed of complicated molecules. Generally, the molecular weight distribution is measured by a gel permeation chromatography (GPC). However, there is no solvent which dissolves the mesophase pitch completely, and the mesophase pitch can not be measured as it is. Therefore, messy operation is required. As for this invention, because the molecular weight distribution is measured with a flow tester, the width of the molecular weight distribution can be judged easily. That is, it can be judged clearly that, when the difference between a flowing start point and a softening point is small, the width of the molecular weight distribution is relatively narrow as compared with the case in which the difference is large.

Since the present invention 1 uses mesophase pitch having an optically anisotropic content of at least 90%, a softening point of 190° C. to 280° C. and a heating weight loss of 0.7% by weight or less at a spinning temperature and the above mesophase pitch is excellent in spinning properties, high-performance carbon fibers can be continuously stably produced for a long time.

Further, the present invention 2 uses mesophase pitch having an optically anisotropic content of at least 90%, a softening point of 190° C. to 280° C. and a difference of 30° C. or less between a flow starting temperature and the softening point and the above mesophase pitch has high orientation and high uniformity so that this mesophase pitch is excellent in flowability. Suchmesophasepitchismelt-spun, infusibilized and carbonized, whereby high-performance carbon fibers excellent in strength and elastic modulus can be produced stably.

The infusibilization can be advantageously carried out by the use of mesophase pitch produced by thermally polymerizing a condensed polycyclic aromatic hydrocarbon in the presence of hydrogen fluoride and boron trifluoride as catalysts. Therefore, carbon fibers can be obtained at high yields.

EFFECT OF THE INVENTION

Mesophase pitch having an optically anisotropic content of at least 90%, a softening point of 190° C. to 280° C. and a heating weight loss of 0.7% by weight or less at a spinning temperature is excellent in spinning properties and high-performance carbon fibers can be continuously stably produced for a long time by using such mesophase pitch as a raw material.

Mesophase pitch having an optically anisotropic content of at least 90%, a softening point of 190° C. to 280° C. and a difference of 30° C. or less between a flow starting temperature and the softening point, measured with a flow tester, has high orientation, the narrow distribution of component molecules and excellent flowability. High-performance carbon fibers excellent in strength and elastic modulus can be stably produced by using such mesophase pitch as a raw material.

EXAMPLES

The present invention will be explained more concretely with reference to Examples. Of course the present invention shall not be restricted by these Examples.

Example 1

1 mole of naphthalene, 0.3 mole of hydrogen fluoride and 0.1 mole of boron trifluoride were charged into an autoclave of 0.5 L, and the mixture was allowed to react for 4 hours at 250° C. After the reaction, the catalysts were separated and recovered. Then, light contents were removed by introducing an inert gas at 350° C. for 24 hours, to obtain mesophase pitch. This mesophase pitch had an optically anisotropic content of 100%, a softening point of 226° C. and a heating weight loss of 0.6% by weight at a spinning temperature. When this mesophase pitch was spun at 301° C., it could be spun without any break of a thread for at least 2 hours. The temperature was increased at a rate of 5° C./min up to 270° C. in the air, and the infusibilization was carried out. Then, the temperature was increased at a rate of 10° C./min up to 1,000° C. and the carbonization treatment was carried out. The so-obtained carbon fiber had a tensile strength of 300 kgf/mm$^2$ and an elastic modulus of 18 tf/mm$^2$.

Example 2

1 mole of naphthalene, 0.3 mole of hydrogen fluoride and 0.1 mole of boron trifluoride were charged into an autoclave of 0.5 L, and the mixture was allowed to react for 4 hours at 250° C. After the reaction, the catalysts were separated and recovered. Then, light contents were removed at 400° C. under 3 Torr, to obtain mesophase pitch. This mesophase pitch had an optically anisotropic content of 100%, a softening point of 240° C. and a heating weight loss of 0.5% by weight at a spinning temperature.

When this mesophase pitch was spun at 315° C., it could be spun without any break of a thread for at least 3 hours. The infusibilization and the carbonization were carried out in the same manner as in Example 1. The so-obtained carbon fiber had a tensile strength of 320 kgf/mm$^2$ and an elastic modulus of 20 tf/mm$^2$.

Comparative Example 1

1 mole of naphthalene, 0.7 mole of hydrogen fluoride and 0.2 mole of boron trifluoride were charged into an autoclave of 0.5 L, and the mixture was allowed to react for 2 hours at 270° C. After the reaction, the catalysts were separated and recovered. Then, light contents were removed by introducing an inert gas at 340° C. for 12 hours, to obtain mesophase pitch. This mesophase pitch had an optically anisotropic content of 100%, a softening point of 248° C. and a heating weight loss of 1.2% by weight at a spinning temperature. When this mesophase pitch was spun at 333° C., the spinning could not be continued for 10 minutes or more. The infusibilization and the carbonization were carried out in the same manner as in Example 1. The so-obtained carbon fiber had a tensile strength of 230 kgf/mm$^2$ and an elastic modulus of 18 tf/mm$^2$.

Comparative Example 2

7 moles of naphthalene, 3 moles of hydrogen fluoride and 1.4 moles of boron trifluoride were charged into an autoclave of 3 L, and the mixture was allowed to react for 2 hours at 260° C. After the reaction, the catalysts were separated and recovered. Then, light contents were removed by introducing an inert gas at 340° C. for 18 hours, to obtain mesophase pitch. This mesophase pitch had an optically anisotropic content of 100%, a softening point of 237° C. and a heating weight loss of 1.0% by weight at a spinning temperature. When this mesophase pitch was spun at 312° C., the spinning could not be continued for 15 minutes or more.

The infusibilization and the carbonization were carried out in the same manner as in Example 1. The so-obtained carbon fiber had a tensile strength of 250 kgf/mm$^2$ and an elastic modulus of 20 tf/mm$^2$.

Example 3

1 mole of naphthalene, 0.4 mole of hydrogen fluoride and 0.1 mole of boron trifluoride were charged into an autoclave of 0.5 L, and the mixture was allowed to react for 4 hours at 280° C. After the reaction, the catalysts were separated and recovered. Then, light contents were removed by introducing an inert gas at 350° C. for 12 hours, to obtain mesophase pitch. This mesophase pitch had an optically anisotropic content of 100%, a softening point of 236° C. and a difference of 22° C. between a flow starting point and the softening point. This mesophase pitch was spun at 312° C. Then, the temperature was increased up to 280° C. at a rate of 3° C./min in the air and the infusibilization was carried out. Then, the temperature was increased up to 1,000° C. at a rate of 10° C./min under an inert gas current and the carbonization was carried out. The so-obtained carbon fiber had a tensile strength of 355 kgf/mm$^2$ and an elastic modulus of 25 tf/mm$^2$.

Example 4

1 mole of naphthalene, 0.7 mole of hydrogen fluoride and 0.15 mole of boron trifluoride were charged into an autoclave of 0.5 L, and the mixture was allowed to react for 2 hours at 280° C. After the reaction, the catalysts were separated and recovered. Then, light contents were removed by introducing an inert gas at 350° C. for 12 hours, to obtain mesophase pitch. This mesophase pitch had an optically anisotropic content of 100%, a softening point of 248° C. and a difference of 25° C. between a flow starting point and the softening point. This mesophase pitch was spun at 323° C. The infusibilization and the carbonization were carried out in the same manner as in Example 3. The so-obtained carbon fiber had a tensile strength of 350 kgf/mm$^2$ and an elastic modulus of 25 tf/mm$^2$.

Comparative Example 3

1 mole of naphthalene, 0.7 mole of hydrogen fluoride and 0.2 mole of boron trifluoride were charged into an autoclave of 0.5 L, and the mixture was allowed to react for 2 hours at 270° C. After the reaction, the catalysts were separated and recovered. Then, light contents were removed by introducing an inert gas at 340° C. for 12 hours, to obtain mesophase pitch. This mesophase pitch had an optically anisotropic content of 100%, a softening point of 248° C. and a difference of 33° C. between a flow starting point and the softening point. This mesophase pitch was spun at 333° C. The infusibilization and the carbonization were carried out in the same manner as in Example 3. The so-obtained carbon fiber had a tensile strength of 230 kgf/mm$^2$ and an elastic modulus of 18 tf/mm$^2$.

Comparative Example 4

7 moles of naphthalene, 3 moles of hydrogen fluoride and 1.4 moles of boron trifluoride were charged into an autoclave of 3 L, and the mixture was allowed to react for 2 hours at 260° C. After the reaction, the catalysts were separated and recovered. Then, light contents were removed by introducing an inert gas at 340° C. for 18 hours, to obtain mesophase pitch. This mesophase pitch had an optically anisotropic content of 100%, a softening point of 237° C. and a difference of 32° C. between a flow starting point and the softening point. This mesophase pitch was spun at 312° C. The infusibilization and the carbonization were carried out in the same manner as in Example 3. The so-obtained carbon fiber had a tensile strength of 250 kgf/mm$^2$ and an elastic modulus of 20 tf/mm$^2$.

What is claimed is:

1. A process for the production of carbon fibers, consisting essentially of melt-spinning mesophase pitch having an optically anisotropic content of at least 90%, a softening point of 190° C. to 280° C. and a heating weight loss of 0.7% by weight or less at a spinning temperature to form a spun fiber, infusibilizing the spun fiber to obtain an infusible fiber and carbonizing the infusible fiber.

2. The process according to claim 1, wherein the optically anisotropic content of the mesophase pitch is 100%.

3. The process according to claim 1, wherein the mesophase pitch is obtained by thermally polymerizing a condensed polycyclic aromatic hydrocarbon in the presence of hydrogen fluoride and boron trifluoride as catalysts.

4. The process according to claim 3, wherein 0.2 to 1 mole of the hydrogen fluoride and 0.05 to 0.5 mole of the boron trifluoride are used per mole of the condensed polycyclic aromatic hydrocarbon.

5. A process for the production of carbon fibers, consisting essentially of melt-spinning mesophase pitch having an optically anisotropic content of at least 90%, a softening point of 190° C. to 280° C. and a difference of 30° C. or less between a flow starting temperature and the softening point, measured with a flow tester, to form a spun fiber, infusibilizing the spun fiber to obtain an infusible fiber and carbonizing the infusible fiber.

6. The process according to claim 5, wherein the optically anisotropic content of the mesophase pitch is 100%.

7. The process according to claim 5, wherein the mesophase pitch is obtained by thermally polymerizing a condensed polycyclic aromatic hydrocarbon in the presence of hydrogen fluoride and boron trifluoride as catalysts.

8. The process according to claim 7, wherein 0.2 to 1 mole of the hydrogen fluoride and 0.05 to 0.5 mole of the boron trifluoride are used per mole of the condensed polycyclic aromatic hydrocarbon.

* * * * *